US009102341B2

(12) United States Patent
Malone, Jr. et al.

(10) Patent No.: US 9,102,341 B2
(45) Date of Patent: Aug. 11, 2015

(54) METHOD FOR DETECTING THE EXTENT OF CLEAR, INTACT TRACK NEAR A RAILWAY VEHICLE

(71) Applicant: Transportation Technology Center, Inc., Pueblo, CO (US)

(72) Inventors: Jerome J. Malone, Jr., Pueblo West, CO (US); Alan L. Polivka, Pueblo West, CO (US)

(73) Assignee: Transportation Technology Center, Inc., Pueblo, CO (US)

( * ) Notice: Subject to any disclaimer, the term of this patent is extended or adjusted under 35 U.S.C. 154(b) by 218 days.

(21) Appl. No.: 13/916,943

(22) Filed: Jun. 13, 2013

(65) Prior Publication Data

US 2013/0334373 A1 Dec. 19, 2013

Related U.S. Application Data

(60) Provisional application No. 61/660,076, filed on Jun. 15, 2012.

(51) Int. Cl.

| | |
|---|---|
| ***B61L 23/04*** | (2006.01) |
| ***B61L 27/00*** | (2006.01) |
| ***B61L 1/18*** | (2006.01) |
| ***B61L 3/24*** | (2006.01) |
| ***B61L 15/00*** | (2006.01) |
| ***B61L 21/10*** | (2006.01) |
| ***B61L 23/16*** | (2006.01) |

(52) U.S. Cl.

CPC ..... *B61L 23/044* (2013.01); *B61L 1/187* (2013.01); *B61L 3/243* (2013.01); *B61L 15/0027* (2013.01); *B61L 21/10* (2013.01); *B61L 23/166* (2013.01); *B61L 27/00* (2013.01); *B61L 27/0038* (2013.01); *B61L 2027/005* (2013.01)

(58) Field of Classification Search

CPC ..... B61L 23/044; B61L 1/181; B61L 3/24; B61L 1/188; B61L 23/168; B61L 3/10

USPC ..... 246/121, 122 R

See application file for complete search history.

(56) References Cited

U.S. PATENT DOCUMENTS

| | | | |
|---|---|---|---|
| 2,605,390 | A | 7/1952 | Judge |
| 3,038,066 | A | 6/1962 | Barry |
| 3,696,243 | A | 10/1972 | Risely |
| 3,742,150 | A | 6/1973 | Sherman et al. |
| 3,808,425 | A | 4/1974 | Campbell et al. |
| 3,946,972 | A | 3/1976 | Grundy |
| 4,389,033 | A | 6/1983 | Hardman |
| 4,415,134 | A | 11/1983 | Wilson |
| 4,728,063 | A | 3/1988 | Petit et al. |
| 4,886,226 | A | 12/1989 | Frielinghaus |

(Continued)

*Primary Examiner* — Zachary Kuhfuss

(74) *Attorney, Agent, or Firm* — Dorr, Carson & Birney, P.C.

(57) ABSTRACT

A method is provided for detecting broken rail, track continuity, and track occupancy ahead of or behind a railroad vehicle traveling in fixed-block territory equipped with an AC track code wayside signal system or cab signal overlay system, and a communications link. This method, when used as an integral part of a communications-based train control (CBTC) or positive train control (PTC) system, allows immediate, automatic detection of broken rail, track occupancies, or open turnouts ahead of or behind a train in an occupied block. It also facilitates true moving-block or virtual block CBTC or PTC, thereby enabling higher efficiency and track utilization.

15 Claims, 9 Drawing Sheets

(56) References Cited

U.S. PATENT DOCUMENTS

| | | | | |
|---|---|---|---|---|
| 4,932,614 | A | 6/1990 | Birkin | |
| 4,979,392 | A | 12/1990 | Guinon | |
| 5,263,670 | A | 11/1993 | Colbaugh et al. | |
| 5,330,134 | A | 7/1994 | Ehrlich | |
| 5,331,288 | A | 7/1994 | Darrow | |
| 5,358,202 | A | 10/1994 | Tse et al. | |
| 5,398,894 | A | 3/1995 | Pascoe | |
| 5,501,416 | A | 3/1996 | Capan | |
| 5,501,417 | A | 3/1996 | Capan | |
| 5,586,736 | A | 12/1996 | Mollet | |
| 5,622,339 | A | 4/1997 | Capan | |
| 5,628,478 | A | 5/1997 | McConnel et al. | |
| 5,680,054 | A | 10/1997 | Gauthier | |
| 6,102,340 | A | 8/2000 | Peek et al. | |
| 6,527,230 | B1 * | 3/2003 | Frick | 246/194 |
| 6,655,639 | B2 | 12/2003 | Grappone | |
| 6,763,290 | B2 | 7/2004 | Johnson | |
| 6,779,761 | B2 * | 8/2004 | Holgate | 246/34 R |
| 7,226,021 | B1 | 6/2007 | Anderson et al. | |
| 7,268,565 | B2 * | 9/2007 | Anderson | 324/713 |
| 7,295,017 | B2 | 11/2007 | Fries | |
| 7,823,841 | B2 | 11/2010 | Anderson et al. | |
| 7,954,770 | B2 | 6/2011 | Tomlinson et al. | |
| 8,175,764 | B2 * | 5/2012 | Kernwein | 701/20 |
| 8,914,171 | B2 * | 12/2014 | Noffsinger et al. | 701/19 |
| 2002/0113170 | A1 | 8/2002 | Grappone | |
| 2003/0038216 | A1 | 2/2003 | Holgate | |
| 2003/0052233 | A1 * | 3/2003 | Frick | 246/194 |
| 2003/0112131 | A1 * | 6/2003 | McAllister | 340/425.5 |
| 2005/0075765 | A1 * | 4/2005 | Oguma et al. | 701/19 |
| 2005/0076716 | A1 | 4/2005 | Turner | |
| 2007/0132463 | A1 | 6/2007 | Anderson | |
| 2007/0145982 | A1 * | 6/2007 | Anderson et al. | 324/522 |
| 2008/0105791 | A1 | 5/2008 | Karg | |
| 2008/0142645 | A1 * | 6/2008 | Tomlinson et al. | 246/122 R |
| 2008/0272245 | A1 | 11/2008 | Mollet et al. | |
| 2008/0296441 | A1 * | 12/2008 | Anderson et al. | 246/121 |
| 2011/0309204 | A1 | 12/2011 | Bohlmann et al. | |
| 2011/0315828 | A1 * | 12/2011 | Bohlmann et al. | 246/167 R |
| 2012/0123617 | A1 * | 5/2012 | Noffsinger et al. | 701/19 |
| 2012/0126065 | A1 * | 5/2012 | Smith et al. | 246/167 R |
| 2013/0284859 | A1 * | 10/2013 | Polivka et al. | 246/34 R |
| 2013/0317676 | A1 * | 11/2013 | Cooper et al. | 701/20 |
| 2014/0014782 | A1 * | 1/2014 | Grappone | 246/121 |
| 2014/0046513 | A1 * | 2/2014 | Cooper et al. | 701/20 |
| 2014/0124628 | A1 * | 5/2014 | Tresanini et al. | 246/194 |
| 2014/0125356 | A1 * | 5/2014 | Cooper et al. | 324/654 |
| 2014/0129154 | A1 * | 5/2014 | Cooper et al. | 702/34 |
| 2014/0138493 | A1 * | 5/2014 | Noffsinger et al. | 246/121 |
| 2014/0207317 | A1 * | 7/2014 | Noffsinger et al. | 701/19 |
| 2015/0053827 | A1 * | 2/2015 | Noffsinger et al. | 246/121 |

* cited by examiner

| Current at Code Transceiver | Train Pickup (relayed via RF) | Meaning |
|---|---|---|
| 1 | 1 | Normal Operating Condition |
| 1 | 0 | Occupancy Behind Train |
| 0 | 1 | System Fault or Tampering |
| 0 | 0 | Rail Break Behind Train |

*Fig. 6*

METHOD FOR DETECTING THE EXTENT OF CLEAR, INTACT TRACK NEAR A RAILWAY VEHICLE

RELATED APPLICATION

The present application is based on and claims priority to the Applicants' U.S. Provisional Patent Application 61/660,076, entitled "Method For Detecting The Extent Of Clear, Intact Track Near A Railway Vehicle," filed on Jun. 15, 2012.

BACKGROUND OF THE INVENTION

1. Field of the Invention.

The present invention relates generally to railway signaling and more particularly, to rail break or vehicle occupancy detection on railroad track. More specifically, the present invention is in the technical field of railroad signaling and train control, including positive train control (PTC), centralized traffic control (CTC), automatic block signaling (ABS), communications-based train control (CBTC) and cab signaling.

2. Background of the Invention.

Conventional railway wayside signaling systems employ the rails of the track for transmission of signals used to detect track occupancy, broken rail and/or open turnouts. Railroad track is physically divided into a plurality of electrically-distinct blocks, each block having a track circuit typically terminated by insulated joints and equipped with bi-directional track code transceivers. It should be understood that the term "code transceiver" should be broadly construed to include any type of track circuit signal transceiver or cab signal transmitter. The code transceivers typically send and receive low-frequency, pulse-modulated carrier signals through the track circuit, thereby communicating signal status to each other. The presence of a train in the block causes the rails to be shunted, interrupting this communication, while the presence of a broken rail in the track causes an open circuit, also interrupting this communication. Additionally, turnouts in the track may be wired such that when not aligned for the normal route, communications will be interrupted. This is commonly known as an open turnout.

A fundamental limitation of fixed-block track circuit systems is their inherent inability to detect a rail break that is located behind a moving train within the same block as the train. Since many rail breaks occur under a train, it would be highly desirable to have the ability to detect broken rail behind a train within the block it is occupying. This would allow immediate notification of a following train or other entity, such as a train dispatching system or back office server.

Another limitation of fixed-block track circuit systems is the inability to detect where within a block an occupancy exists. Therefore, the entire block must be assumed to be occupied from the perspective of the signaling system. This inability to distinguish a track occupancy from a rail break, and the inability to locate where the occupancy or break is within the block artificially limits maximum traffic density on the track and therefore fundamentally restricts how efficiently a given track can be utilized. It would be highly desirable to have a true "moving-block" or "virtual block" train control system, including the ability to detect rail breaks, open turnouts or occupied track behind a train's current position within the same block that the train occupies, enabling the full potential benefit of CBTC implementation.

The present invention at least partially overcomes these limitations by using equipment on the leading or trailing end (if so equipped) of a railway vehicle to detect conventional track code or cab signal code in the track, and thereby determine if the track ahead of or behind the vehicle, but still in the same block, is occupied or has a broken rail. Information regarding reception of these signals is then transmitted over a wireless RF link to following trains, possibly via one or more wayside systems or a central office system and correlated with train location information, giving a positive, fail-safe closed-loop indication of rail integrity and the extent of track vacancy. This information may be used in the generation of movement authorities or restrictions for trains as an integral part of a CBTC or PTC system, allowing a fail-safe implementation of a moving-block or virtual block train control system.

In some embodiments of the present invention, the wayside signal equipment is customized to provide additional pulsed codes assigned to a series of blocks to give a vital indication of which track a vehicle is occupying, thereby facilitating determination of vehicle location in a CBTC or PTC system.

In some embodiments of the present invention, the current present in the track circuit of each block is monitored at each wayside track code transceiver. By appropriately correlating, using an RF link, the current measurements with the pulsed carrier signals and the carrier signals received by the vehicle, it is possible to distinguish a track occupancy from a rail break ahead of or behind a vehicle. This information may form an integral part of a CBTC or PTC system.

SUMMARY OF THE INVENTION

This invention provides a method for detecting a rail break or track occupancy ahead of or behind a train in an occupied block of track. The present invention employs commonly-used wayside signaling AC track code equipment and/or cab signaling overlay equipment, in conjunction with an RF communications link, possibly a train location determination system, and may be used as an integral component of a communications-based train control (CBTC) or positive train control (PTC) system to facilitate moving-block or virtual block operation.

The present invention detects, in real time, rail breaks occurring ahead of (or behind, if a system is mounted on the rear of the train) a moving train within an occupied block, and relays this information, along with train location information, to wayside systems or to a CBTC or PTC system. This is a function not performed by current fixed-block wayside signal systems, in that currently-used fixed-block wayside signal systems do not provide an indication that track immediately behind a train within the same block is unoccupied and free of rail breaks so that a following train could occupy it, unrestricted up to the leading train.

Conventional fixed-block wayside signal systems use the track as a transmission line, transmitting and receiving pulsed codes indicating block or signal status. If equipped with a cab signal overlay system, codes are picked up by railway vehicles and used to convey signal status to the operator. The present invention receives track codes or cab signal codes on the vehicle using conventional pickup coils inductively coupled to the rails, and uses them as a positive indication of rail integrity. When codes are present on a track, they are detected, may be interpreted, and reception of the codes is communicated back, via an RF wireless link, to wayside equipment, office equipment, or equipment on a following train, which may be part of a CBTC or PTC system. Thus, an indication of rail integrity may be conveyed, directly or indirectly, to following trains, effectively extending signaling indications or movement authorities, or to relax a restriction, where appropriate. Indication of the presence of code behind a train, along with that train's location (e.g., from GPS) can be used by a CTC or PTC system to allow a following train to advance unrestricted to the leading train's end position.

Some embodiments of the present invention are fully compatible with existing traditional AC track circuit-based block signaling systems, particularly when implemented as an integral part of a CBTC or PTC system where train and traffic control functions are handled by radio communications rather than track circuits and wayside signals. Thus, in some embodiments, the present invention will allow existing traditional track-circuit based signaling infrastructure to be optimized for rail break detection rather than signaling. This could allow, for example, fewer and longer track circuits and/or improved rail break detection.

In other embodiments of the present invention, codes are placed on a separate carrier, or a continuous carrier of frequency not used by wayside signaling systems, cab signal systems or overlay systems. The present invention may be implemented as an overlay system capable of functioning simultaneously with track code and cab signal systems. In one such embodiment, the coded electrical signals may include unique identifying characteristics assigned to each track segment to enable the onboard receiving and processing unit to distinguish the track segments. For example, unique codes or carrier frequencies may be assigned to particular track segments in multiple track territory, giving a nearly continuous, positive indication of which track a vehicle is occupying and which direction it is travelling in, solving a persistent problem in CBTC or PTC systems which rely on GPS.

The present invention overcomes several fundamental limitations of conventional fixed-block track circuit broken rail detection, including the inherent minimum limit on train separation and track utilization efficiency. In railway terminology, this invention allows shorter headways.

These and other advantages, features, and objectives of the present invention will be more readily understood in view of the following detailed description and the drawings.

BRIEF DESCRIPTION OF THE DRAWINGS

The present invention can be more readily understood in conjunction with the accompanying drawings, in which:

FIG. 6 is a table showing the logical states and meanings associated with various conditions of the wayside track current detector and onboard pickup system.

DETAILED DESCRIPTION OF THE INVENTION

Figure 1:
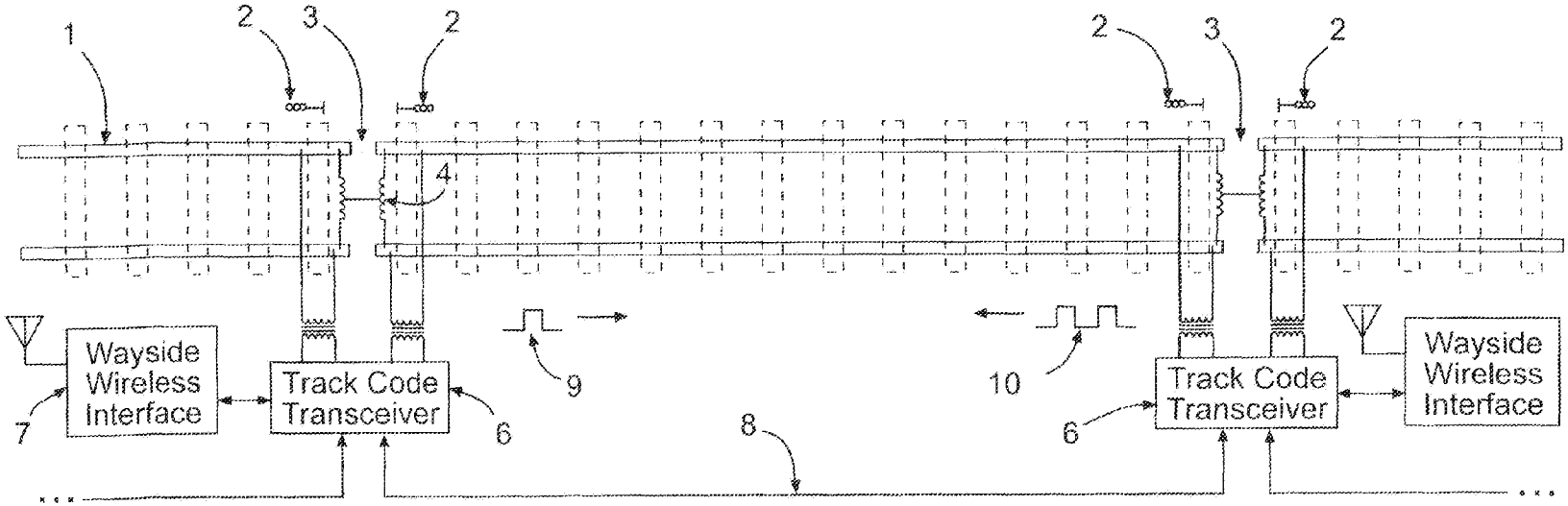
FIG. 1 is a pictorial diagram showing a section of railroad track divided into blocks and equipped with an AC track code signaling system with RF links. Pulses sent and received by the track code transceivers are shown, as is wayside cabling between transceivers.

Before describing in detail the system and method for detecting broken rail or occupied track from a moving locomotive, it should be observed that the present invention resides primarily in what is effectively a novel combination of conventional electronic circuits, electronic components, and signal processing/estimation algorithms, and not in the particular detailed configurations thereof. Accordingly, the structure, control, and arrangement of these conventional circuits, components, and algorithms have been illustrated in the drawings by readily understandable block diagrams which show only those specific details that are pertinent to the present invention, so as not to obscure the disclosure with structural details which will be readily apparent to those skilled in the art having the benefit of the description herein. Thus, the block diagram illustrations of the figures do not necessarily represent the mechanical or structural arrangement of the exemplary system, but are primarily intended to illustrate the major structural components of the system in a convenient functional grouping, whereby the present invention may be more readily understood.

With reference now to FIG. 1, there is shown a pictorial diagram illustrating a section of railroad track 1. The track 1 is divided into a series of electrically-isolated blocks or track segments, one of which is shown in its entirety in the figure, and is familiar to those versed in the art. For signaling purposes, each block is typically electrically-isolated from neighboring blocks by insulated joints 3 installed in the track, shown here as gaps. The track may or may not be equipped with impedance bonds 4, which allow conduction of common-mode traction current across the insulated joints 3 while providing isolation for out-of-phase signaling currents. The track is equipped with conventional track circuits and may have wayside signals 2, operated by a series of code transceivers and associated equipment 6 installed at the ends of each block. In this figure, the code transceivers are shown coupled to the track via a transformer, but other connections are possible. The code transceivers and associated equipment 6 may have a landline link 8 or radio link 7 connecting it to the other transceivers or to a central office system. For the purposes of this disclosure, the term "central office" should be broadly construed to include any type of central communications or traffic control system, as well as back office servers, wayside servers, communications or traffic control systems.

With continued reference to FIG. 1, the code transceivers 6 communicate with each other using coded electrical signals via the rails of the track 1 as a transmission line. For example, these coded electrical signals can have one or more continuous low-frequency carrier waves (typically 100 or 250 Hz, but others are in use) modulated by track code pulses 9, 10 from the neighboring transceivers. The specific protocol and meaning of the track code pulses 9, 10 depend on the particular code system in use. Typically, there are three or more different codes, each used to indicate wayside signal status or permissible train speed. In addition to track code pulses 9, 10, the transceivers may or may not transmit cab signal overlay information, depending on the particular territory and equipment in use thereon. If a CBTC or PTC system is in use, one or more of the block stations may be equipped with a wayside wireless interface 7 capable of digital communications with locomotives or other railroad vehicles and equipment over one or more RF channels.

Figure 2:
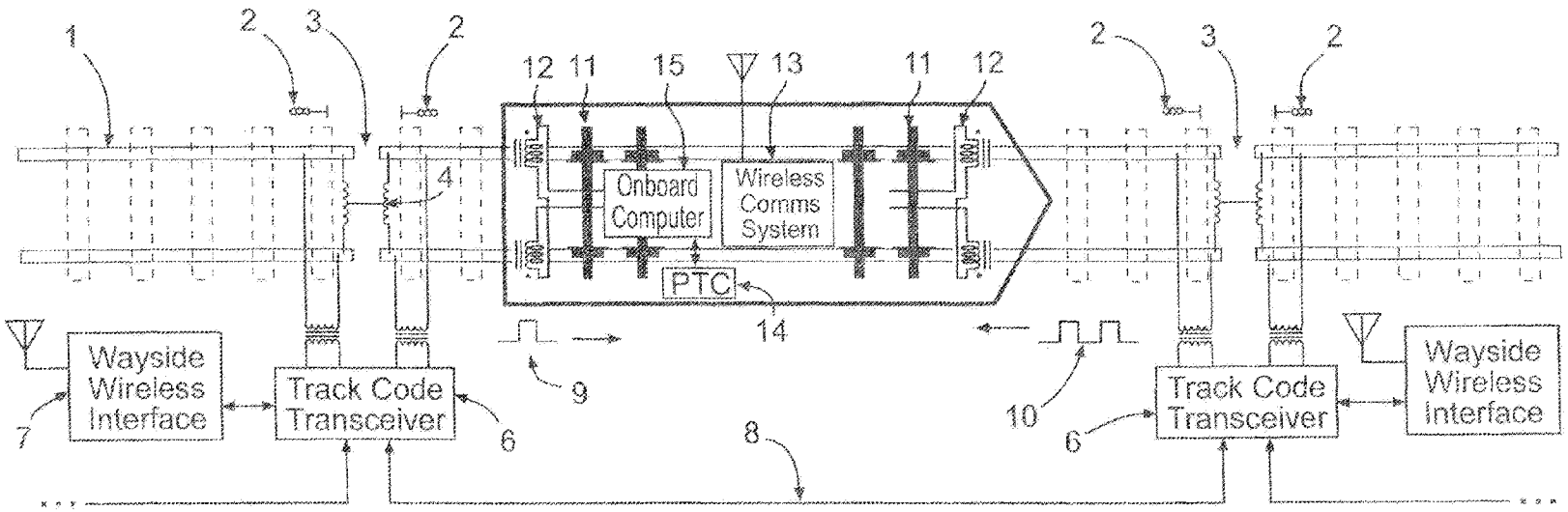
FIG. 2 is a pictorial diagram showing a section of railroad track divided into blocks with a railway vehicle occupying the central block. The vehicle is equipped with magnetic field pickup coils inductively coupled to the track in front of the leading wheels and behind the trailing wheels. These pickup coils are similar or identical to those conventionally used for cab signaling. The vehicle is also equipped with an RF wireless communications system capable of communicating with wayside equipment, office equipment, or directly to a following train, possibly as part of a communications-based train control system (CBTC) or positive train control (PTC) system.

With reference now to FIG. 2, there is shown a locomotive or other railway vehicle occupying a block of track. The railway vehicle is equipped with an onboard receiving and processing unit to receive the coded electrical signals from code transceivers 6 via the track 1. In addition, when a block of track or series of blocks is occupied, the track code pulses 9, 10 are unable to reach the neighboring transceivers because of the shunting action of the axles 11 of the vehicle. The onboard train control unit on the railway vehicle may be equipped with a cab signal receiver and pickup coils 12. These pickup coils can be laminated-core, multi-turn coils placed above and perpendicular to each rail and connected in series, but wound or connected in opposite directions. The coils 12 are inductively (magnetically) coupled to the rails, so as to respond additively when out-of-phase sinusoidal magnetic fields are present in each rail and respond destructively when a common-mode magnetic field intercepts both of the coil cores. Such pickup coils are well known by those versed in the art. Similar receiver coils may be used to receive track code information 9, 10 when present. In the present invention, signals picked up by the receiver coils 12 are filtered and interpreted by an onboard computer 15 within the onboard receiving and processing unit on the locomotive. The onboard computer 15 is configured to communicate with (or may be an integral part of) PTC equipment 14 or a wireless communications system 13 capable of communicating over one or more external stations (e.g., over RF links to wireless interface units 7 on the wayside, to base stations, or to a central office system). In one embodiment, when code or cab signal information is received by the coils 12 and interpreted by the onboard computer 15, the onboard computer 15 periodically or continually communicates receipt of the code or cab signal code information to the wayside or to a central office system via the RF wireless communication system link 13, or communicates receipt of valid track code or cab signal information, detected at the rear of the train, to the onboard CBTC or PTC equipment 14 of a following vehicle. The onboard computer 15 may, additionally, communicate the status of the wayside signaling system or the type of code protocol received at the vehicle to the CBTC or PTC system or central office system as an additional check to ensure that the vehicle is traveling in the correct territory. The wayside or central office system receives information about railway vehicle location and correlates it with track code information received at the vehicle to determine the extent of clear track behind the railway vehicle and available to a following vehicle.

For the purposes of this disclosure, the term "external station" should be broadly construed to include, but not be limited to any type of wayside system, base station or central office system, as well as a mobile communications system on another railway vehicle capable of communications with the onboard receiving and processing unit described above. Communications between the onboard receiving and processing unit on the railway vehicle and an external station can be accomplished via an RF communication link, or by means of electrical signals carried via the track and code transceiver to an external station. The present invention can also be implemented using a TCP/IP communications protocol between the onboard receiving and processing unit on a railway vehicle and an external station.

Figure 3:
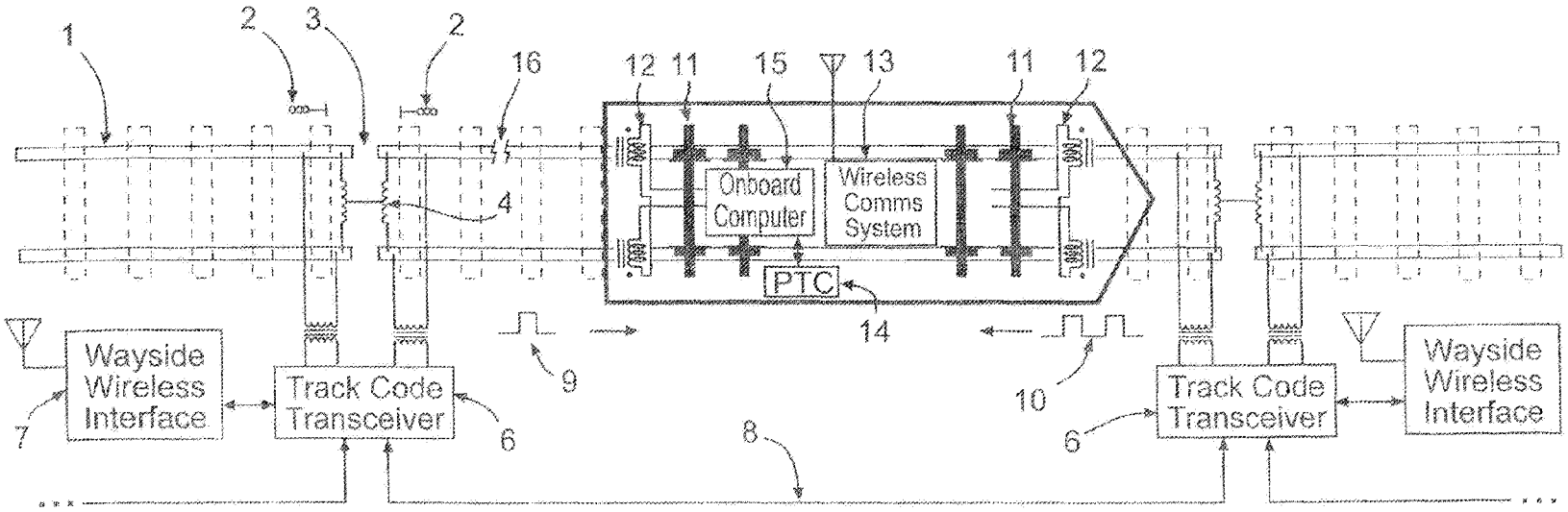
FIG. 3 is a pictorial diagram similar to that of FIG. 2, with the exception that the rail has broken after passage of the vehicle, creating a non-conducting gap in the rail behind the vehicle.

With reference now to FIG. 3, a similar arrangement is shown, with the exception that the rail 1 has broken after passage of the railway vehicle, creating a non-conducting gap 16 in the rail. In this situation, no coded electrical signals will be received by the pickup coils 12, as the flow of current in the track circuit has been interrupted by the gap 16. The gap 16 causes the track circuit to be open, preventing current from flowing under the pickup coils 12 and causing loss of signal at the onboard computer 15. The onboard computer 15 reports loss of signal to the external station (e.g., the CBTC or PTC system interface 14 or directly to a wayside system 7 or a central office system via an RF communications link 13).

Figure 4:
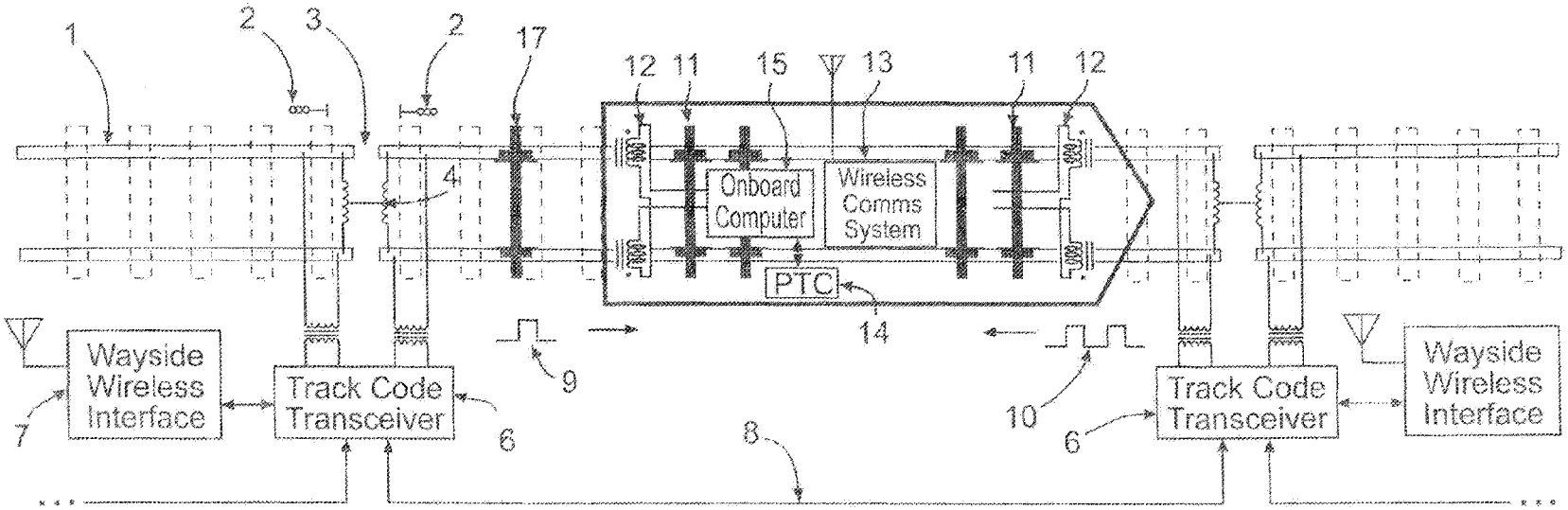
FIG. 4 is a pictorial diagram similar to that of FIG. 2, with the exception that a second vehicle has entered the block after passage of the first vehicle. The leading axle of the second occupying vehicle is shown.

With reference now to FIG. 4, a similar arrangement is shown, with the exception that a second railway vehicle has entered the block behind the occupying vehicle. The leading axle 17 of the intruding vehicle is shown. The axle 17 causes the rails to be shunted, preventing current from flowing under the pickup coils 12 and causing loss of the coded electrical signals at the onboard computer 15. The control computer 15 reports the loss of signal to the external station (e.g., the CBTC or PTC system interface 14 or directly to the wayside system or a central office system computer via an RF communications link 13). The PTC system 14 can use this information to restrict a possible reverse move by the leading vehicle.

Figure 5:
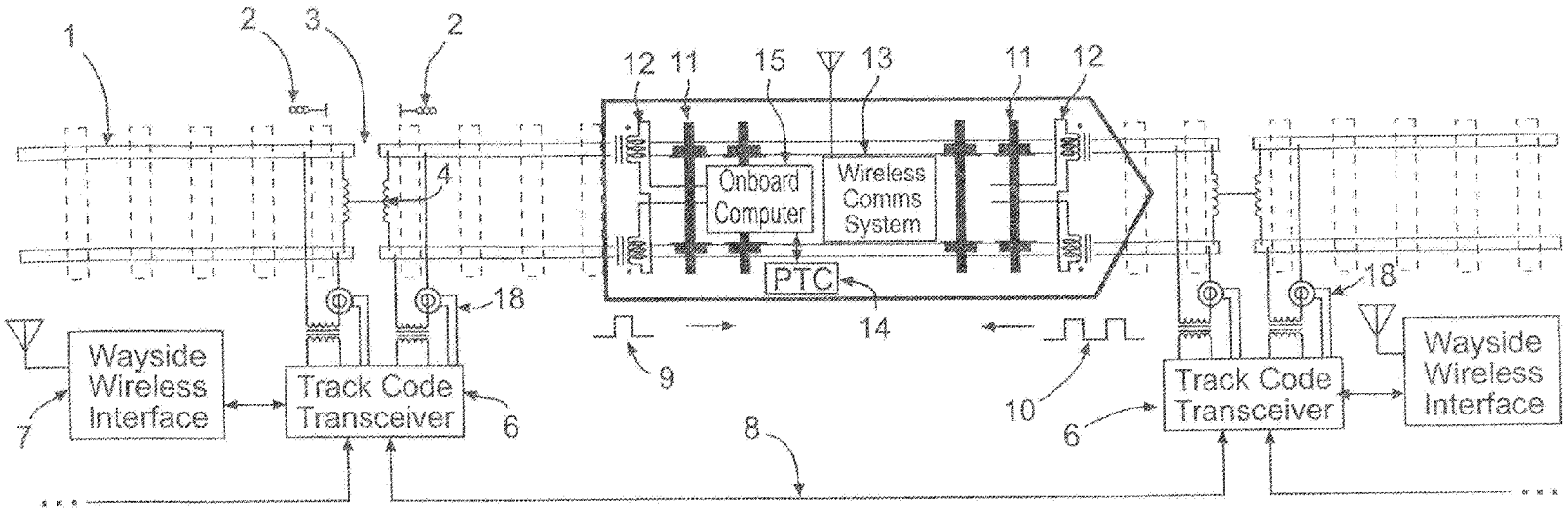
FIG. 5 is a pictorial diagram similar to that of FIG. 2, with the exception that a current monitoring device has been added to the track circuit at each of the track code transceivers.

With reference now to FIG. 5, there is shown a similar arrangement to those illustrated in the previous figures, with the exception that a current sensor 18, in the form of a resistive shunt or a current transformer (toroid) has been installed on one of the track leads. With the current sensor in place, the resulting current flowing in the track circuit can be monitored. In normal situations, such as with an unoccupied block as is illustrated in FIG. 1, current flow is measured and presence of current flow is relayed, via either wireless RF link 7 or landline link 8 (e.g., cable or optical fiber) to the next block transceiver or to an element of a PTC or CBTC system. When a rail break occurs and the block is unoccupied, no current will flow. When the block is occupied and there is neither a rail break nor an unintended occupancy in that end of the block, as illustrated in FIG. 2, the wayside system will detect current flow and the onboard receiving unit will detect current flow as well, and will communicate this information to the external station (e.g., wayside or a central office server) via the communications link. If a rail break occurs behind a moving vehicle, as illustrated in FIG. 3, current will be detected neither by the wayside system nor by the onboard system. However, if an unintended occupancy occurs behind the moving train, as illustrated in FIG. 4, current will be detected by the wayside system but not by the onboard receiving and processing unit. Thus, by monitoring current in the block at each track code transceiver, and relaying such information to a CBTC or PTC system, while simultaneously monitoring the presence of track code by the onboard receiving and processing unit, a CBTC, PTC, or wayside system can distinguish between an unintended track occupancy and a rail break.

Referring now to FIG. 6, there is shown a logic table illustrating the meaning of various combinations of states of a wayside track current sensor and the onboard receiving and processing unit located at the rear of the railway vehicle. In the table, the numeral 1 indicates that the signal is present or being detected in the block occupied by the vehicle, as shown in FIG. 5, while a 0 indicates absence of the signal or that it is not being detected. Allowing for track circuit leakage current, when current is flowing in the track circuit and current is simultaneously flowing behind a vehicle occupying a block so as to be detected by the present invention, the system is functioning normally with neither a rail break nor a track occupancy behind the vehicle. If current is flowing in the track circuit but little or none detected by the pickup coils, an occupancy has occurred behind the train. If current is not flowing in the track circuit but the coded electrical signal is detected by the pickup coils of the onboard receiving and processing unit, a fault state is indicated, or spurious interference is being picked up by the coils, possibly indicating tampering or sabotage. If no current is detected in the track circuit and coded electrical signals are not detected by the onboard receiving and processing unit, a rail break exists behind the train. The same logic applies to the track circuit ahead of, and within the same block as the railway vehicle.

Figure 7:
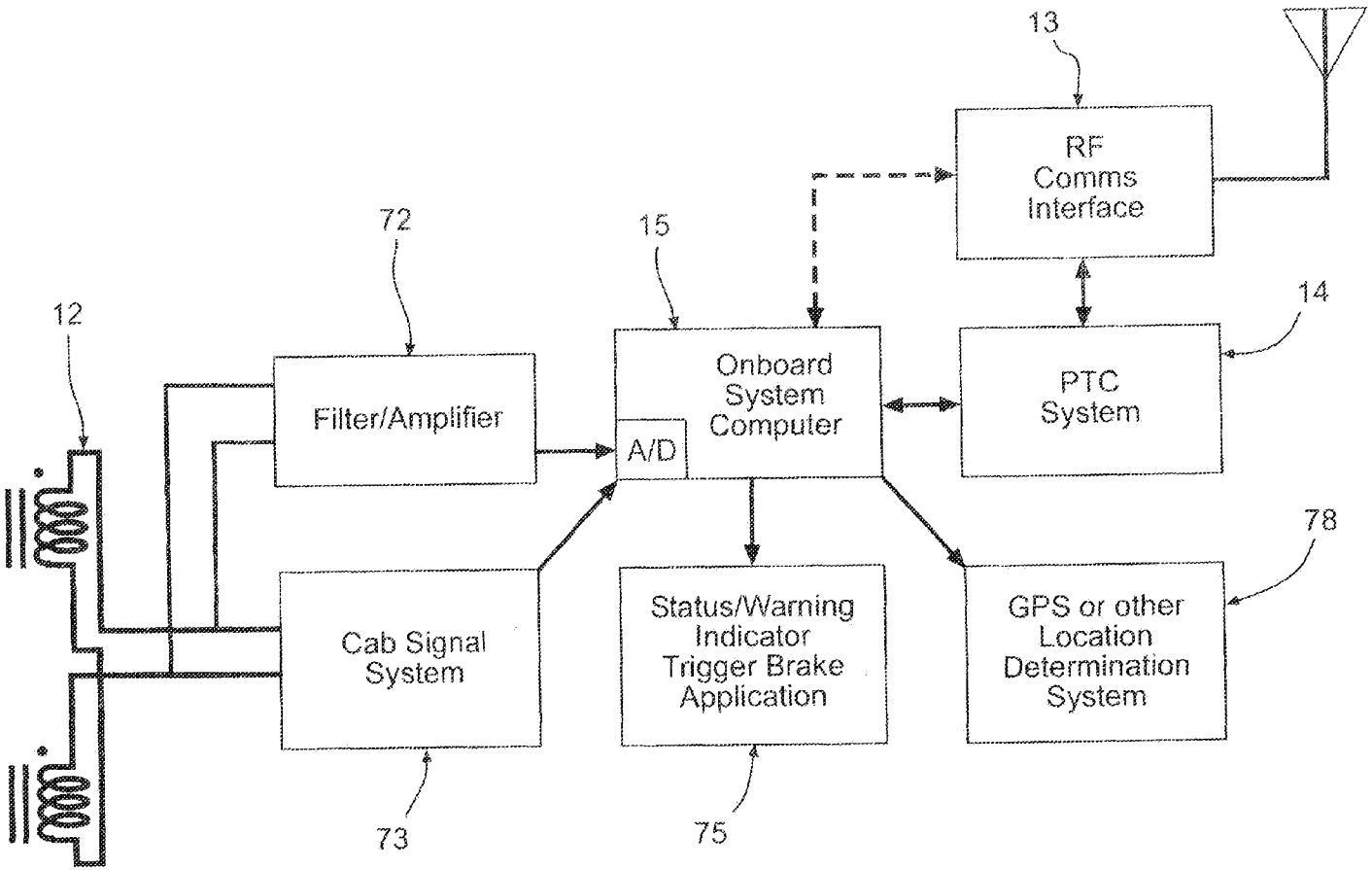
FIG. 7 is a block diagram of an embodiment of the present invention illustrating the fundamental components and signal flow paths of the invention.

Referring now to the invention in greater detail, with reference now to FIG. 7, there is shown a block diagram of the onboard receiving and processing unit providing a basic embodiment of the present invention. The series-connected, reversed pickup coils 12 are connected to an optional analog filter/amplifier unit 72. The filter/amplifier 72 includes a high impedance buffer so as not to load the pickup coils or interfere with the cab signal system 73, if present. In some embodiments, the filter/amplifier 72 includes a 50 or 60 Hz notch filter to eliminate interference caused by coupling of power line magnetic fields and may also include a 25 Hz notch filter to eliminate stray magnetic interference from traction currents. The onboard computer 15 receives the filtered and amplified signal via an analog-to-digital converter, and carries out digital signal processing operations to demodulate the received signal and interpret the pulse codes. An existing cab signal unit 73 may or may not be present. In some embodiments, the onboard control computer 15 connects to an indicator panel or device 75 to warn the operator of an impending rail break or track occupancy, and such a device can also be used to initiate a brake application. The onboard computer 15 communicates with, and may operate as an integral part of a positive train control (PTC) system 14 or may have a separate means of communicating status to wayside with an RF communications interface 13. When loss of track code or cab signal code, possibly after waiting a suitable time, is determined by the onboard control computer 15, the loss is communicated to wayside systems, to another vehicle, or to a central office system via the RF communications link 13, possibly via the PTC system 14. Location information provided by a GPS or other location determination system 78 is included in the message sent over the RF link by the wireless communications system 13, allowing a wayside or central office server to closely determine the location of rail breaks that occur behind a moving train.

Figure 8:
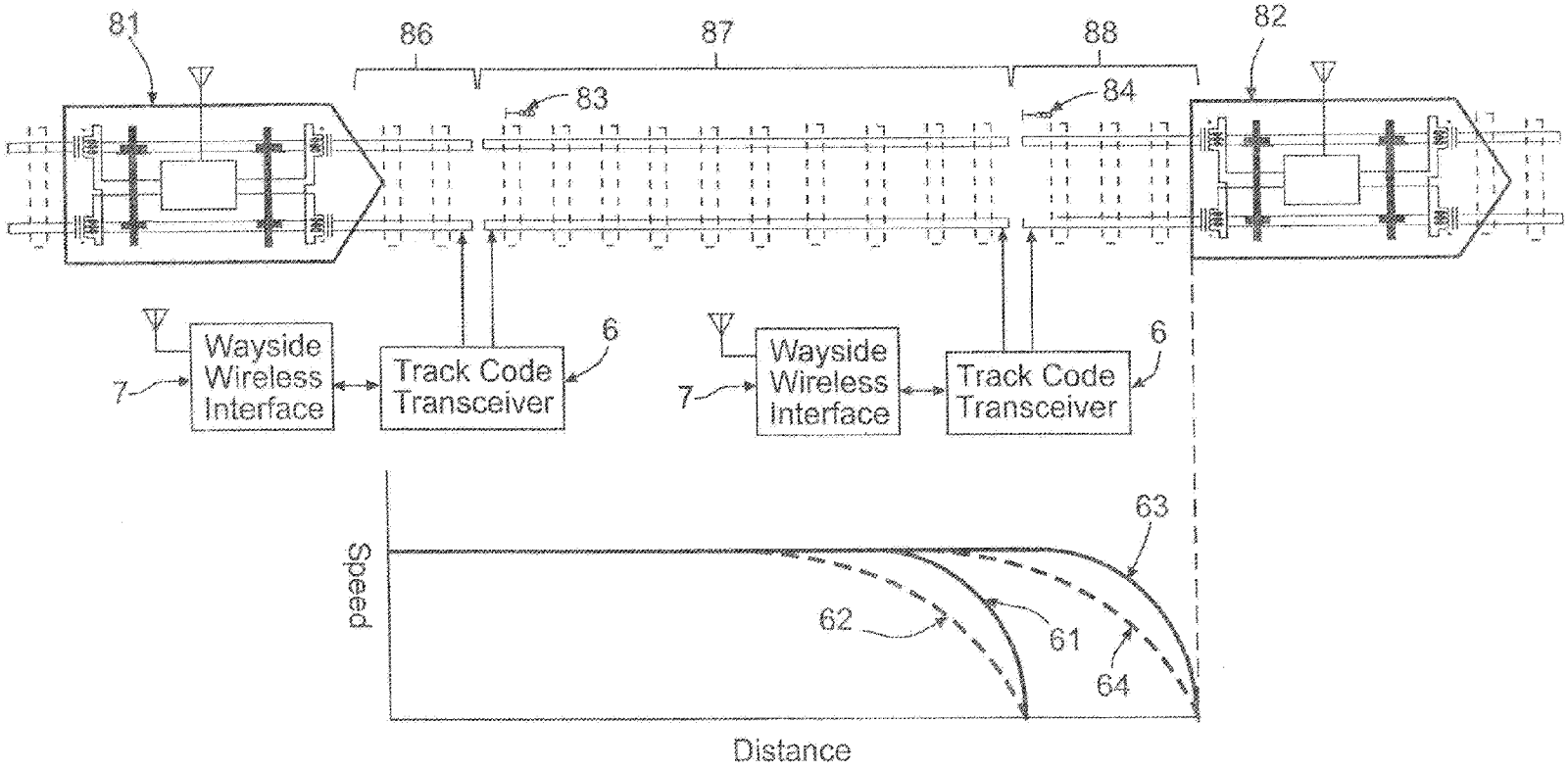
FIG. 8 is a diagram showing three consecutive blocks of railroad track on which the second train follows the first train with a clear block between them. Information about the integrity of the clear block, the portion of the block behind the leading train, and the portion of the block ahead of the following train, is communicated to the following train. Speed profiles, with and without the present invention, are shown below.

With reference to FIG. 8, three consecutive blocks of track are shown. A following railway vehicle 81 occupies the left-most block 86; the center block 87 is clear, while the right-most block 88 is occupied by the trailing end of a leading vehicle 82. Insulated joints 3 separate the blocks 86, 87 and 88. Wayside signals 83, 84 may be present at the beginning of each block. Bidirectional code transceivers 6 transmit and receive through the rails of each block, and are equipped with wayside wireless RF interface units 7. In a normal situation, without the benefit of the present invention, the following vehicle 81 would receive an approach indication from the first wayside signal 83 and a stop or restricting indication at the second wayside signal 84, as the leading vehicle 82 is occupying the right-most block 88. The speed curves, possibly computed by a braking algorithm in a PTC system, of the following vehicle 81 would resemble the enforcement curve 61 and warning curve 62 shown in the lower part of the figure.

With continued reference to FIG. 8, the integrity of the track between the following railway vehicle 81 and a portion of the left-most block 86 is verified by magnetic pickup of track code or cab signal overlay code at the following vehicle 81. The status and integrity of the entire central block 87 is conveyed to a central office system and/or to the following vehicle 81 by RF wireless communications links (e.g., wireless interface units 7). Alternatively, the status and integrity of the central block 87 can also be inferred at vehicle 81 by the signal 83 aspect being conveyed through the track. The track integrity of the portion of the right-most block 88 behind the leading vehicle 82 is determined by magnetic pickup by that vehicle of track code sent from signal location 84, and such indication of integrity is relayed via wireless communications link back to the following vehicle 81, and/or processed by a central office or wayside system before reaching the following vehicle 81. The resultant benefit is that the following vehicle 81 may now travel to a stopping point just short of the end of the leading vehicle 82 rather than being stopped or slowed at the beginning of the third (right-most) block 88. The speed curves, possibly computed by a braking algorithm by a PTC system, of the following vehicle 81 would now more closely resemble the enforcement curve 63 and warning curve 64 shown in the lower part of the figure.

Figure 9:
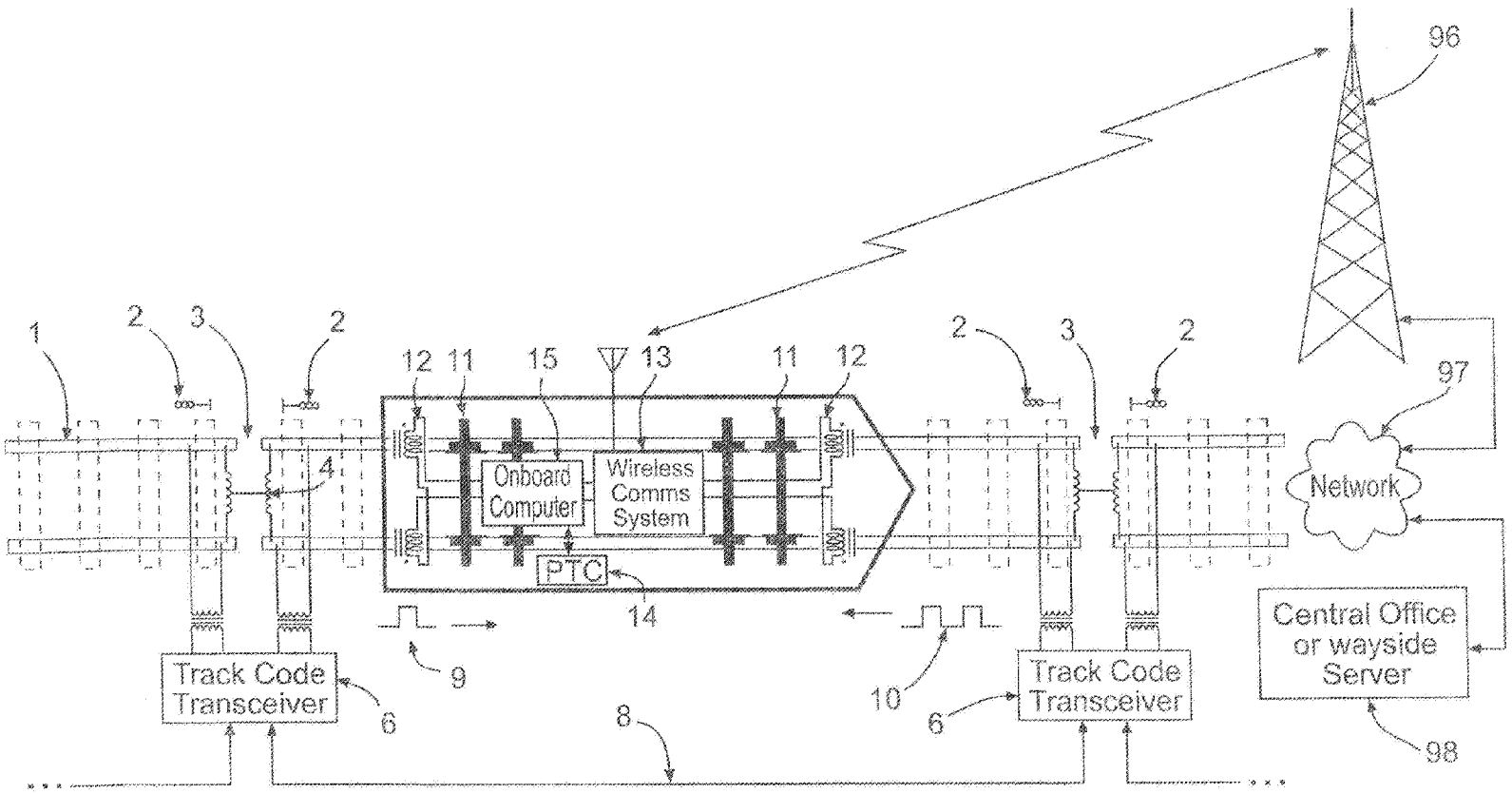
FIG. 9 is a pictorial diagram similar to that of FIG. 2, illustrating a preferred embodiment of the present invention, in which the onboard system reports information about the track immediately behind it to a central communications-based train control (CBTC) system via RF link and network.

With reference to FIG. 9, there is illustrated a particularly preferred embodiment of the present invention, in that it does not necessarily require any modifications to existing wayside track circuit hardware, it does not necessarily require PTC or CBTC wayside interface units, nor does it require wireless communication links at each block boundary 3. Further, it can achieve significantly shorter headways than would a conventional fixed-block train control system. This embodiment is of a moving block or virtual block PTC system. Each train has on board a location determination system (possibly comprising GPS, tachometer, inertial sensors and/or track database feeding into an onboard computer-hosted algorithm, such as a Kalman filter) and a data radio, that frequently reports the current vehicle location to a central office server, wayside server 98, or directly to a following train through a base station radio 96 and network 97. Along with each location report, the onboard computer also reports whether or not it is currently receiving track code from the cab signal receiver at the rear of the vehicle. Based on knowing train length and integrity thereof, the onboard computer 15 or the off-board server 98 computes the rear of the railway vehicle or train location as an offset from the reported front of the vehicle location. Movement authorities or virtual signal status indications are frequently sent (updated) to trains from the off-board server 98. As a train moves forward and provides a new location report, the server 98 provides an updated movement authority to a following train, permitting it to advance to the most recently reported location of the rear of the leading vehicle or train. The following vehicle also reports its location and rear track code detection status to the server so that a train following it can, in turn, receive an updated movement authority, and so on. Without the present invention, a following train could not proceed without restriction beyond the track circuit block boundary nearest to, but behind the leading train. At steady state speeds for leading and following vehicles, the present invention can result in a reduction in headway of approximately one track circuit block length.

In some embodiments, the wayside track code transceivers transmit a series of pulses or a continuous carrier into the track, such carrier being at a frequency unused by any existing wayside signaling or cab signal equipment, and the onboard system is equipped with frequency-selective filters to pass only that frequency, thereby giving a continuous indication of the absence of rail breaks or shunting track occupancies.

In some embodiments, the onboard computer queries, through a variety of possible means, existing cab signal equipment, to determine if a valid cab signal code had been received. If such is the case, the control computer then communicates this status, via an RF communications link, PTC, CBTC, or other means, to wayside equipment or a central office system, as reception of cab signal information is a valid means of verifying track integrity.

In some embodiments, analog means are used to detect the code signals in the coil.

In other embodiments, a Hall Effect or other similar magnetic-field or current-sensing receiving device may be used instead of the pickup coils.

In yet another embodiment, a flat coil of relatively large area, oriented directly over the track, or wound and oriented in such a way that its magnetic flux would cut through the circuit formed by the rails and leading axle, may be used to perform the receive function.

In some embodiments, the onboard computer or another processor, automatically applies capacitances across the pickup coils or otherwise tunes a resonant circuit formed partially by the coils, adjusting the resonant frequency to improve the signal-to-noise ratio.

In some embodiments, the onboard computer has the ability to trigger a train stop or indicate to the locomotive operator that the train is approaching the end of unoccupied and intact track.

In yet another embodiment, the control computer has the ability to communicate with, directly, or indirectly via a wayside system, CBTC, or PTC system, other railway vehicles in nearby blocks, warning them of upcoming occupied track, broken rail, or open turnouts detected behind the present vehicle.

In other embodiments, the wayside transceiver units are configured to send and receive unique codes on each track in multiple track territory. The onboard computer interprets the code and confirms the code to the PTC system, giving a positive, vital, and nearly continuous indication of which track the vehicle is currently occupying, and in which direction the train is travelling.

In some embodiments, a continuous carrier of unique frequency (not on a known harmonic frequency of commonly used carriers) is superimposed on existing track codes by the wayside transceivers from wayside units to train. Narrowband filters are applied to the signal from the pickup coils, and such frequency is continuously monitored by the onboard computer. Absence of such frequency is sufficient indication of either a rail break, track occupancy, or both.

In some embodiments, a route database containing an index of track codes used on various track segments in various geographical areas is used by the control computer, in conjunction with GPS information or other train control position, location, wheel tachometer or other systems, to provide a record of expected track codes for various geographic locations, records of known dead spots, dark territory, places where excessive interference may be encountered (i.e., galvanic protection for pipelines, etc.). Alternatively, such information may be provided by, or downloaded from a CBTC or PTC system server.

While the invention has been described in terms of various specific embodiments, those skilled in the art will recognize that the invention can be practiced with variations and modifications within the spirit and scope of these claims. The invention should not be limited by the embodiments described above, but by all embodiments and methods within the scope and spirit of the invention.

Further, while we have shown and described an embodiment in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

We claim:

1. A method for detection of a broken rail, track occupancy, or open turnout from a railway vehicle on a railroad track having a series of electrically-isolated track segments, wherein each adjacent pair of track segments is equipped with code transceivers, said code transceivers communicating with each other and with railway vehicles on the track by coded electrical signals transmitted via the track, said method comprising:

providing an onboard receiving and processing unit on a railway vehicle on the railroad track to receive the coded electrical signals via the track, with a communications link to communicate with an external station;

transmitting coded electrical signals from a code transceiver via the track to the onboard receiving and processing unit on the railway vehicle, wherein the coded electrical signals include unique identifying characteristics assigned to each track segment;

detecting the current in the track associated with the coded electrical signals at the code transceiver;

monitoring at the onboard receiving and processing unit to determine whether the coded electrical signals are received via the track;

identifying the track segment on which the railway vehicle is located based on the unique identifying characteristics of the coded electrical signals received by the onboard receiving and processing unit;

reporting via the communications link to the external station whether the coded electrical signals are received at the onboard receiving and processing unit; and determining whether a track occupancy or a broken rail exists between the onboard receiving and processing unit and the code transceiver, based on whether the coded electrical signals are received at the onboard receiving and processing unit and whether track current is detected at the code transceiver; whereby a broken rail is indicated if the coded electrical signals are not received by the onboard receiving and processing unit and no track current is detected at the code transceiver, and track occupancy is indicated if the coded electrical signals are not received by the onboard receiving and processing unit and track current is detected at the code transceiver.

2. The method of claim 1 wherein the onboard receiving and processing unit further comprises coils inductively coupled to the track to receive the coded electrical signals.

3. The method of claim 1 wherein the onboard receiving and processing unit communicates receipt of said coded electrical signals via an RF communications link to a central office.

4. The method of claim 1 wherein the onboard receiving and processing unit communicates receipt of said coded electrical signals to a central office.

5. The method of claim 1 wherein the onboard receiving and processing unit receives coded electrical signals from the code transceiver located ahead of the railway vehicle.

6. The method of claim 1 wherein the onboard receiving and processing unit receives coded electrical signals from the code transceiver located behind the railway vehicle.

7. The method of claim 6 wherein the communications link provides information from the onboard receiving and processing unit to an external station on a following railway vehicle as to whether a track occupancy, broken rail, or open turnout exists within the same track block behind the railway vehicle sending the information.

8. The method of claim 7 wherein the communications link further provides information from the onboard receiving and processing unit to an external station on a following railway vehicle regarding the location of the railway vehicle sending the information.

9. The method of claim 7 further comprising extending the PTC/CBTC movement authority of, or relaxing the PTC/CBTC restriction on the following railway vehicle if no track occupancy, broken rail, or open turnout is detected between the railway vehicle and the following railway vehicle.

10. A method for detection of a broken rail, track occupancy, or open turnout from a railway vehicle on a railroad track having a series of electrically-isolated track segments, wherein each adjacent pair of track segments is equipped with code transceivers, said code transceivers communicating with railway vehicles on the track by coded electrical signals transmitted via the track, said method comprising:

providing an onboard receiving and processing unit on a railway vehicle on the railroad track to receive the coded electrical signals via the track, with a communications link to communicate with an external station;

transmitting coded electrical signals from a code transceiver via the track to the onboard receiving and processing unit on the vehicle, wherein the coded electrical signals include unique identifying characteristics assigned to each track segment;

detecting the current in the track associated with the coded electrical signals at the code transceiver;

monitoring at the onboard receiving and processing unit whether the coded electrical signals are received via the track;

identifying the track segment on which the railway vehicle is located based on the unique identifying characteristics of the coded electrical signals received by the onboard receiving and processing unit;

reporting via the communications link to the external station whether the coded electrical signals are received at the onboard receiving and processing unit;

determining whether a track occupancy exists between the onboard receiving and processing unit and the code transceiver, indicated if the coded electrical signals are not received at the onboard receiving and processing unit and track current is detected at the code transceiver;

determining whether a broken rail or open turnout exists between the onboard receiving and processing unit and the code transceiver, indicated if the coded electrical signals are not received at the onboard receiving and processing unit and no track current is detected at the code transceiver; and determining whether normal track conditions exist between the onboard receiving and processing unit and the code transceiver, indicated if the coded electrical signals are received at the onboard receiving and processing unit and track current is detected at the code transceiver.

11. The method of claim 10 wherein the onboard receiving and processing unit further comprises coils magnetically coupled to the track to receive the coded electrical signals.

12. The method of claim 10 wherein the onboard receiving and processing unit receives coded electrical signals from the track transceiver located ahead of the railway vehicle.

13. The method of claim 10 wherein the onboard receiving and processing unit receives coded electrical signals from the track transceiver located behind the railway vehicle.

14. The method of claim 13 wherein the communications link provides information from the onboard receiving and processing unit to a following railway vehicle as to whether a track occupancy or a broken rail exists within the same track block behind the railway vehicle sending the information.

15. The method of claim 14 further comprising automatically extending the PTC/CBTC movement authority of, or relaxing the PTC/CBTC restriction on the following train if no track occupancy or broken rail is detected between the railway vehicle and the following train.

* * * * *